US005175523A

United States Patent [19]

Huey et al.

[11] Patent Number: 5,175,523

[45] Date of Patent: Dec. 29, 1992

[54] ADJUSTABLE COAXIAL DOUBLE-DISK FLUID COOLED WAVEGUIDE WINDOW WITH MEAN FOR PREVENTING WINDOW BOWING

[75] Inventors: Hugo E. Huey, Cupertino; Przemyslaw I. Reysner, Campbell; Yosuke M. Mizuhara, Palo Alto; Erik N. Jongewaard, Sunnyvale, all of Calif.

[73] Assignee: Varian Associates, Inc., Palo Alto, Calif.

[21] Appl. No.: 669,174

[22] Filed: Mar. 14, 1991

[51] Int. Cl.[5] ..... H01P 1/08; H01J 23/36

[52] U.S. Cl. ..... 333/252; 315/39

[58] Field of Search ..... 333/252; 315/39

[56] References Cited

U.S. PATENT DOCUMENTS

| | | | |
|---|---|---|---|
| 3,018,453 | 1/1962 | Okress et al. | 333/252 |
| 3,339,102 | 8/1967 | Johnson | 315/3 |
| 3,345,534 | 10/1967 | Johnson et al. | 315/39 |
| 3,675,165 | 7/1972 | Ueda et al. | 333/252 |
| 4,286,240 | 8/1981 | Shively et al. | 333/252 |
| 4,371,854 | 2/1983 | Cohn et al. | 333/252 |
| 4,620,170 | 10/1986 | Lavering et al. | 333/252 |
| 4,965,541 | 10/1990 | Okazaki | 333/252 |

FOREIGN PATENT DOCUMENTS

| | | | |
|---|---|---|---|
| 0343594 | 11/1989 | European Pat. Off. . | |
| 130449 | 5/1989 | Japan | 333/252 |
| 171885 | 6/1965 | U.S.S.R. . | |
| 669250 | 6/1952 | United Kingdom | 333/252 |
| 908808 | 10/1962 | United Kingdom | 333/252 |

*Primary Examiner*—Eugene R. LaRoche
*Assistant Examiner*—Benny T. Lee

[57] ABSTRACT

A gyrotron microwave output window made of a pair of centrally coupled dielectric disks in which the displacement between the windows is tunable by adjusting means external to the waveguide and in which the window central coupling automatically compensates for such adjustments and for coolant pressure changes.

3 Claims, 2 Drawing Sheets

ADJUSTABLE COAXIAL DOUBLE-DISK FLUID COOLED WAVEGUIDE WINDOW WITH MEAN FOR PREVENTING WINDOW BOWING

FIELD OF THE INVENTION

The invention pertains to vacuum-sealed dielectric windows for transmitting electromagnetic waveguide waves between sections of waveguide containing differing atmospheres, such as a high-vacuum electron tube and a pressurized waveguide. Such windows are generally dielectric plates sealed across the metallic hollow waveguide. Windows have been a major limitation to use of high power at high microwave frequencies. The principal problems have included waveguide arcs which can locally thermally crack the dielectric, dielectric loss which causes stress due to thermal expansion, mechanical failure from the gas pressure differential and wave reflection from the electrical discontinuities of the window structure, Design and improvement of windows has always been a major problem.

PRIOR ART

Art directly pertinent to the present invention includes:

U.S. Pat. No. 3,345,535 issued Oct. 3, 1967 to Floyd O. Johnson and Louis T. Zitelli illustrates two well-known methods for cancelling wave reflection from the discontinuities in dielectric constant: Each window is a plate of thickness about ½ of a wavelength in the dielectric-filled guide transmitting a transverse-electric wave ($TE_{on}$), so that the reflections at its two faces add out-of-phase and cancel at the center frequency. Also, the two windows are displaced by ¼ wavelength of the evacuated or coolant-filled guide, giving a similar cancellation. The combination cancels reflections over a wider frequency band.

U.S. Pat. No. 4,286,240 describes circulating fluid coolant inside the window structure over a window surface.

SUMMARY OF THE INVENTION

An object of the invention is to provide a circular waveguide window capable of handling high power at high frequency in a waveguide mode having zero electric field at the center.

A further object is to provide a window capable of withstanding high pressure coolant.

A further object is to provide a window with improved coolant flow.

A still further object is to provide a window which is adjustable to control its wave reflection properties.

These objects are achieved by a window assembly comprising two parallel dielectric plates, spaced apart, with coolant flow confined between them. For the high coolant flow and pressure needed at very high power, and the thin dielectric needed at high frequency, the stress in the plates is reduced by applying an inward force between the plates by a coaxial structure at the axial center of the plates where the fields are low.

DESCRIPTION OF THE PREFERRED EMBODIMENTS

One of the main limitations of waveguide windows is heat dissipation. At very high frequency, the dielectric must become very thin, preferably one half of a wavelength in the dielectric-loaded guide. At high frequency the dielectric loss gets high, so cooling fluid is circulated over one surface of the window, raising the pressure on the coolant side while in an electron tube it remains zero on the vacuum side. Two parallel windows, spaced apart, are used to channel the coolant for higher velocity. The pressure tends to bend the two plates apart so that, eventually, mechanical breakage can occur. The invention provides means to relieve this stress.

Figure 1:
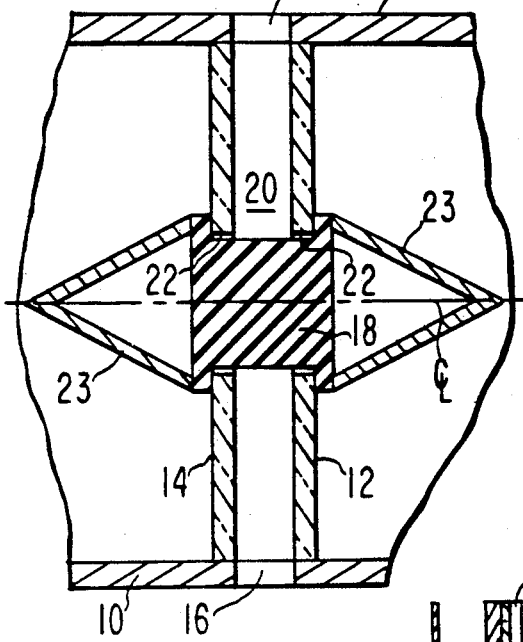
FIG. 1 is a schematic axial section of a window embodying the invention.

FIG. 1 illustrates schematically the invention. A metallic waveguide 10 (circular, preferably), is sealed off by a pair of window plates 12, 14 of a dielectric such as sapphire. To remove heat, a fluid coolant 20 such as fluorocarbon FC75 is circulated between plates 12, 14 through ports 16. The pressure of coolant 20 bows plates 12, 14 outward at their centers. To reduce the mechanical stress, plates 12, 14 are supported at their centers as shown by a metallic or dielectric bridging plug 18, vacuum sealed to plates 12, 14. In this schematic geometry, plug 18 is symmetrical about the center line, CL, of waveguide 10 and would be sealed into apertures 22 at the centers of plates 12, 14.

The invention is particularly applicable to microwave generator tubes such as gyrotrons where the output power is in a higher-order $TE_{om}$ or a $TE_{nm}$ waveguide mode where n is an integer higher then 1, in which the transverse fields fall to zero at the center and m is mode number representing the number of changes in field direction over a ½ λg in the direction of the waveguide axis. Thus the wave-reflecting discontinuity by dielectric or metallic plug 18 is minimized. To cancel reflections from the discontinuities in dielectric constant, window plates 12, 14 are preferably an odd number of guide half-wavelengths, thick in the dielectric and spaced apart by an odd number of guide quarter-wavelengths in the dielectric coolant 20. An alternative construction would be to omit plate apertures 22 and seal plug 18 to the flat inner surfaces of plates 12, 14. This however, puts the ceramic-to-metal seal in tension as the pressure is raised and plates 12, 14 tend to bow outward. The ceramic-to-metal seal is weakest in tension. To further cancel reflections and possible mode conversion, tapered shields 23 are attached to the ends of plug 18, making the conversion from a hollow waveguide to a coaxial guide relatively smooth. Both the $TE_{om}$ and $TE_{nm}$ guides are far from cutoff of many spurious modes, so minimizing reflections of the spurious modes is desirable. Additional attenuation of spurious modes can be effected by using high electrically resistive metals, coatings or lossy dielectric materials for the coaxial tapered shields 23 and plug 18. This can improve gyrotron output stability and operating range.

Figure 2:
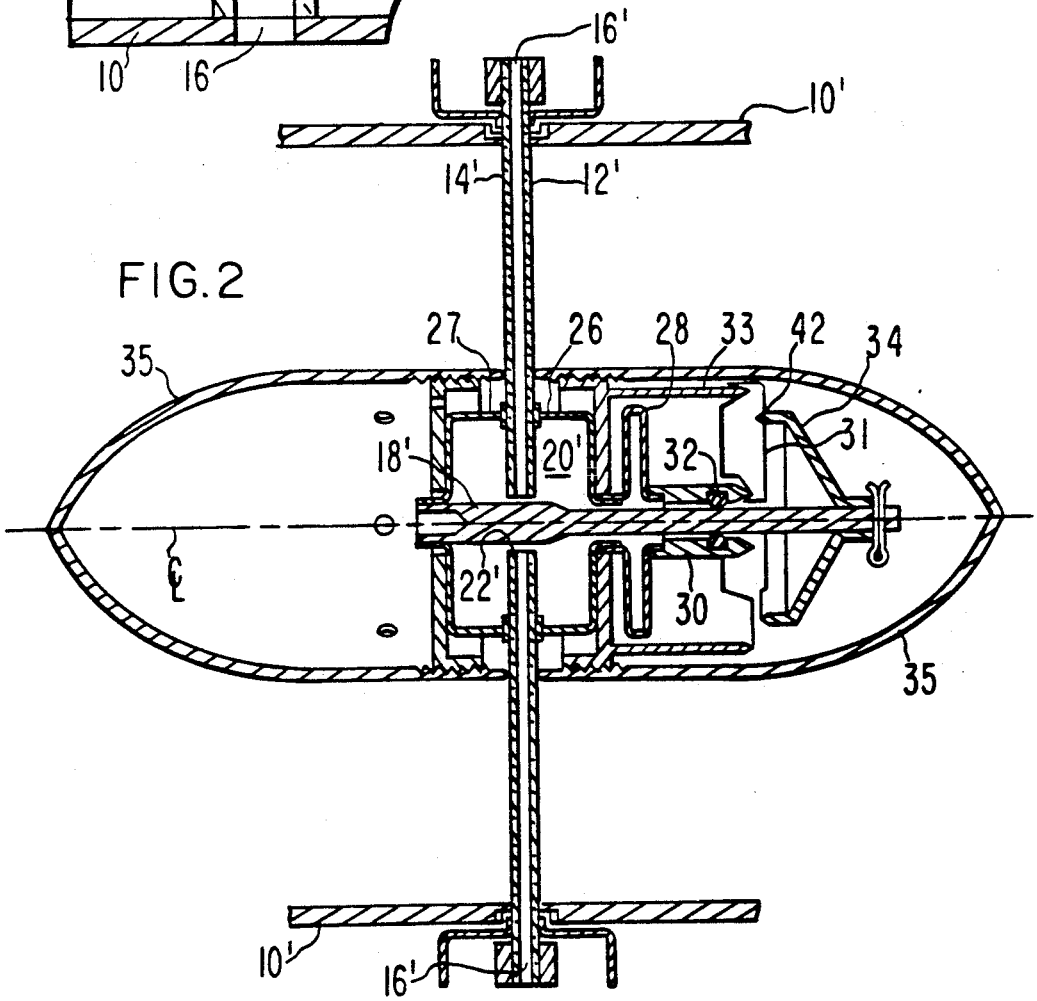
FIG. 2 is an axial section of an embodiment using a flexible diaphragm.

FIG. 2 illustrates a mechanical structure for the invention. The pair of dielectric plates 12' and 14' are separated by a gap 16' for circulating coolant. The plates are shown coupled to the gyrotron output waveguide wall 10' through the adjustment means shown more fully in FIG. 4. Central tension shaft 18′ passes through apertures 22′ in window plates 12′, 14′. The pressure of coolant fluid 20′ is resisted by a pair of domed compression members 26, 27 sealed to the outsides of plates 12′, 14′. The center of dome 27 is sealed as by brazing, to tension shaft 18′. The center of dome 26 is sealed to the center of a flexible diaphragm 28, in this case one fold of a flexible metallic bellows, but several folds may be used, or a piston may also be used. The other end of diaphragm 28 is sealed to one end of a hollow tube 30 which surrounds tension shaft 18′.

The far end of tube 30 pushes on the inner ends of a set of levers 31 whose outer ends pivot on a tube 33 mechanically fixed to dome 26 and cover 35. Intermediate pivots 42 push, via a conical transfer casing 34, on the far end of tension shaft 18′. The leverage lengths are designed to amplify the expansive force of diaphragm 28′ in order to counteract the fluid pressure force on the much greater area of the insides of plates 12′, 14′. Thus tension in shaft 18′ and resulting force on plate 14′ via cover 35 and dome 27 are increased to compensate for fluid pressure of coolant 20′. Equal force on the outside of plate 12′ is provided by the reactive thrust on cover 35 and from diaphragm 28 through the linkage of parts 30,31,33,34. By selecting size and flexibility of diaphragm 28 and the length ratios of levers 31 the effect of fluid pressure can be nearly cancelled.

Tension shaft 18′ is free to slide inside tube 30 and is sealed from the surrounding dielectric atmosphere with an O-ring 32 to seal in coolant 20′. The outer end of tension shaft 18′ may be contained by a nut to adjust the static load on plates 12′, 14′.

Figure 3:
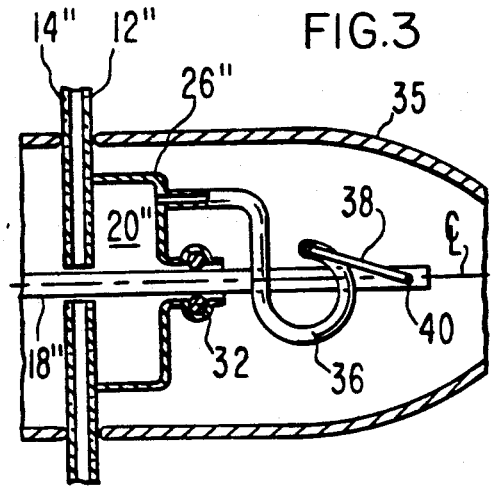
FIG. 3 is an axial section of an embodiment using a Bourdon tube.

FIG. 3 is a partial sketch of a somewhat different embodiment for applying force to the central shaft 18″. The coolant fluid is circulated through the window plates 14″ and 12″. Attached to dome 26″ which is full of coolant 20″ is a Bourdon pressure tube 36 similar to those used in pressure gauges. The outer end of tube 36 is connected by a crank 38 and crank pin 40 to the outer end of tension rod 18″. The pressure-correcting force may be adjusted by selecting properties of Bourdon tube 36 and the angle of crank 38.

The above described pressure mechanisms have irregular shapes which would perturb the field in waveguide 10 as well as be susceptible to waveguide arcing. The pair of generally conical conductive shield covers 35 provide smooth, axially symmetric conductive surfaces to prevent perturbation and arcs and to provide smooth transitions between the mode patterns of the useful wave in hollow waveguide 10 and in the short coaxial guide of the metallic support region. Also, as described above, the symmetrical cones minimize excitation of spurious, low-order modes. As described above the usual modes of gyrotron operation use modes whose electric fields fall to zero on the axis and rise slowly with radial distance, so the tapered transition is gradual and relatively non-reflecting.

Wave reflections from the double-disc window at very short wavelengths are sensitive to the exact spacing of the two discs, so it is advantageous to provide means to mechanically adjust this spacing for minimum reflection. The fixed restraint of FIG. 1 does not permit adjustment. For embodiments of the invention similar to that of FIG. 2, however, adjustment can be provided, even with the added feature of adjustment from outside the waveguide (with power flowing).

Figure 4:
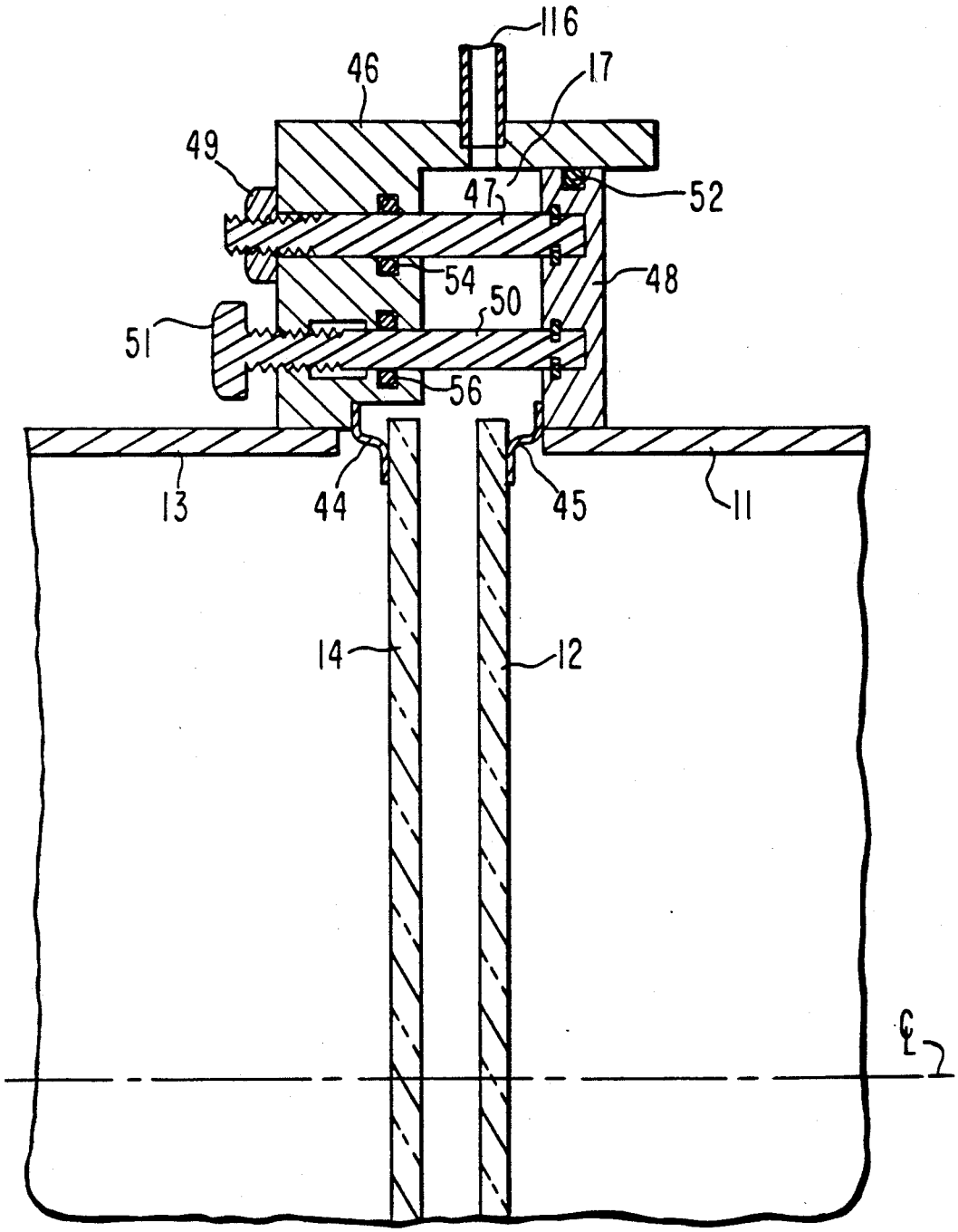
FIG. 4 is a partial section of the perimeter of an inventive window.

FIG. 4 illustrates one of many possible adjusting mechanisms. Attached through annular L shaped cross-section brackets 44 and 45 to the periphery of window discs 12,14 are the two parts 46,48 of a coolant manifold chamber 17. Part 48 is a flange bonded to the gas-filled section 11 of waveguide 10. It is slideably contained in the cup-shaped flange 46 which is bonded to the evacuated section 13 and sealed with an O-ring 52 to form the gas-tight coolant manifold 17.

Manifold flanges 46,48 are connected by two rings of bolts 47,50 disposed radially as shown, or alternating around a single circle. Compressor bolts 47 are sealed to moveable flange 48 and expander bolts 50 are threaded through fixed flange 46. Nuts 49 on compressors 47 and bolt-heads 51 on expanders 50 permit adjustment of the spacing between flanges 46,48 and hence between window plates 12,14. O-rings 54,56 prevent coolant leakage around bolts 47,50. Thus the impedance match of the composite window can be fine-tuned from outside the waveguide assembly.

The above preferred embodiments are illustrative and not limiting. Many different mechanical embodiments will occur to those skilled in the art. The invention is to be limited only by the following claims and their legal equivalents.

We claim:

1. In a microwave tube output waveguide for connection directly to an electromagnetic wave output port of a microwave tube which output port, in operation, is at vacuum pressures comprising, a microwave window, said microwave window including a pair of parallel dielectric plates having a separation therebetween, each said plate having a broad surface, the broad surface of the plates opposed to each other, one of said plates sealing the vacuum of said microwave tube and said microwave window coupling out electromagnetic waves generated in said microwave tube;

said output waveguide being of circular cross section and having an exterior periphery and an axis, said pair of dielectric plates being mounted across said circular cross section of said output waveguide with said broad surface of each plate being perpendicular to said axis, each said dielectric plate having a central, axially aligned aperture therethrough, said opposed broad surfaces of said plates being respective interior faces of said dielectric plates;

means for introducing, in operation, fluid between and in contact with said interior faces of said dielectric plates for cooling said interior faces of said plates;

first flange means fixed to said exterior periphery of a first portion of said output waveguide and to an annular peripheral face region of one of said dielectric plates;

second flange means fixed to said exterior periphery of a second portion of said output waveguide and to an annular peripheral face region of the other of said dielectric plates;

adjustment means coupled between said first and second flange means to permit peripheral adjustment of said separation between said plates, and mechanical means responsive to said adjustment means, said mechanical means being located near the axis of said waveguide and passing through said centrally aligned apertures, said mechanical means coupling each said plate together to resist bowing of said plates due to pressure of said cooling fluid between said plates and for permitting said separation between said plates near the axis of said waveguide to follow said separation between said plates at the periphery of said waveguides.

2. The waveguide output of claim 1 wherein each said dielectric plate has an exterior face on a side plate opposite from the corresponding interior face; and said mechanical means includes a diaphragm for transmitting fluid pressure from said cooling fluid to a lever coupled to said exterior faces of both of said plates for automatically compensating for fluid pressure changes in said cooling fluid.

3. The waveguide of claim 2 wherein said mechanical means includes a cover fixed thereto, said cover being shaped as a figure of revolution about said axis, said cover including a portion disposed, in operation, in said vacuum and said portion being smoothly tapered to an apex; and said cover being layered with a lossy dielectric material for absorbing microwaves.

* * * * *